US007296941B2

(12) United States Patent
Suzuki et al.

(10) Patent No.: US 7,296,941 B2
(45) Date of Patent: Nov. 20, 2007

(54) TAPE PRINTER AND TAPE CREATING METHOD

(75) Inventors: Yasunori Suzuki, Nagoya (JP); Yuichiro Suzuki, Okazaki (JP); Naoki Tanjima, Nisshin (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 11/542,737

(22) Filed: Oct. 4, 2006

(65) Prior Publication Data

US 2007/0086821 A1 Apr. 19, 2007

(30) Foreign Application Priority Data

Oct. 18, 2005 (JP) ..... 2005-302392

(51) Int. Cl.
*B41J 11/00* (2006.01)

(52) U.S. Cl. ..... 400/615.2; 400/611; 400/578

(58) Field of Classification Search ..... 400/76, 400/578, 611, 615.2
See application file for complete search history.

(56) References Cited

U.S. PATENT DOCUMENTS 5,454,653 A 10/1995 Miwa
6,106,176 A * 8/2000 Yanagisawa et al. .... 400/615.2
7,004,654 B2 * 2/2006 Shibata et al. ..... 400/615.2
2005/0036817 A1 2/2005 Wilken et al.

FOREIGN PATENT DOCUMENTS

| | | |
|---|---|---|
| EP | 0598600 A2 | 5/1994 |
| JP | 6-155809 | 6/1994 |
| JP | 6155809 | 6/1994 |

* cited by examiner

*Primary Examiner*—Minh Chau
(74) *Attorney, Agent, or Firm*—Day Pitney LLP

(57) ABSTRACT

It is intended to provide a tape printer and a tape creating method which can achieve a high degree of accuracy and constant length of printing even when the rotational speed of a DC motor changes due to the increase of a wire-wound resistance value because of the heat generation of the DC motor under the continuous driving and the load change by the replacement of a tape. The print cycle algebra is corrected in each time when a pulse number inputted from the photo sensor reaches a control pulse number. Line printing on the surface tape is performed by means of the thermal head with this print cycle algebra as a print cycle.

12 Claims, 10 Drawing Sheets

FIG. 6

81

| TAPE TYPE | TAPE TYPE CORRECTION VALUE |
|---|---|
| 3.5mm, RECEPTOR | 1 |
| 6mm, LAMINATE | 0.985 |
| 6mm, RECEPTOR | 1 |
| 9mm, LAMINATE | 0.985 |
| 9mm, RECEPTOR | 1 |
| 12mm, LAMINATE | 0.985 |
| 12mm, RECEPTOR | 1 |
| 18mm, LAMINATE | 0.985 |
| 18mm, RECEPTOR | 1 |
| 18mm, LETTERING/FABRIC | 1 |
| 24mm, LAMINATE | 0.985 |
| 24mm, RECEPTOR | 1 |

FIG. 7

82

| CONVEYANCE LENGTH CORRECTION VALUE | TAPE LENGTH CORRECTION VALUE |
|---|---|
| +3 | 1.03 |
| +2 | 1.02 |
| +1 | 1.01 |
| 0 | 1 |
| -1 | 0.99 |

WHEN CORRECTION PRINT CYCLE IS AT 36 PULSES

TAPE PRINTER AND TAPE CREATING METHOD

CROSS-REFERENCE TO RELATED APPLICATIONS

This application claims priority from JP 2005-302392, filed Oct. 18, 2005, the contents of which are hereby incorporated by reference.

TECHNICAL FIELD

The disclosure relates to a tape printer and a tape creating method which performs printing on the long tape by means of a print head while conveying a long tape.

BACKGROUND

Conventionally, there have been variously proposed tape printers and tape creating methods which performs printing on a long tape by means of a print head while conveying the long tape with a tape conveyance mechanism which is driven by a DC motor.

For instance, Japanese Patent Application laid-open No. H6(1994)-155809 (paragraphs[0008] to [0021], and FIGS. 2 to 5) discloses a tape printer comprising a print head for printing dot-pattern data on a printing medium, a conveyance mechanism for conveying the printing medium relative to the print head, and control means for controlling the print head and the driving mechanism. The tape printer further comprises a DC motor for driving the conveyance mechanism, and rotating at a constant rotational speed, without detecting a rotation angle. Printing is inhibited while the rotational speed of the DC motor is not constant immediately after the DC motor starts rotating. After the rotational speed of the DC motor becomes constant, printing is performed at a stable frequency.

As described above, the DC motor which is inexpensive and has a good energy efficiency characteristic can be employed to the drive motor of the conveyance mechanism for conveying the printing medium relative to the print head, thus a low-cost dot printer of which power consumption is low.

The tape printer comprising the conventional structures as above, however, is arranged to previously determine the rotational speed of the DC motor by resistance values of a variable resistance and a control IC. When a wire-wound resistance value increases because of the heat generation of the DC motor under the continuous driving, the rotational speed of the DC motor changes, thereby getting difficult to provide fixed-length printing with high precision. The rotational speed of the DC motor also changes due to the load change depending on the tape type.

To solve the above problems, the printing operation can be performed with the thermal head at every predetermined number of rotations of the DC motor while an encoder detects the rotational speed of the DC motor. However this causes another problem that a user cannot modify a conveyance length of the tape in accordance with the predetermined rotational speed of the DC motor. Thus, a conveyance length correction to adjust the print length cannot be performed.

SUMMARY

The disclosure has been made in view of the above circumstances and has an object to overcome the above problems and to provide a tape printer and a tape creating method which can achieve a high degree of accuracy and constant length of printing of a high quality by correction of a print cycle of a print head even when the rotational speed of a DC motor changes due to the increase of a wire-wound resistance value because of the heat generation of the DC motor under the continuous driving and the load change by the replacement of a tape. It is also intended to provide a tape printer and a tape creating method in which a user can perform a tape length correction to adjust the print length by correcting the print cycle of the print head.

To achieve the purpose of the disclosure, there is provided a tape printer comprising: a tape conveyance mechanism having a DC motor as a drive source to convey a long tape; a detection device that repeatedly detects a drive time in which the DC motor reaches a predetermined degree of rotation; a first storage unit that preliminarily stores an initial print cycle; a correction print cycle calculating unit that calculates a correction print cycle based on the drive time detected by the detection device; a print head that performs printing dot-pattern data on the tape conveyed by the tape conveyance mechanism; and a print control unit that drives and controls the print head, wherein the print control unit drives and controls the print head at the initial print cycle and the correction print cycle calculated by the correction print cycle calculating unit.

Accordingly, even when the rotational speed of the DC motor changes due to the increase of a wire-wound resistance value because of the heat generation of the DC motor under the continuous driving and the load change by the replacement of the tape, the print cycle of the print head is corrected in each time when a degree of rotation of the DC motor reaches a predetermined degree of rotation. Thus, constant length of printing of a high quality can be achieved by the correction of the print cycle of the print head.

Further, measurement of the degree of rotation of the DC motor by means of the encoder is achieved by repeated detection of a drive time (for example, a drive time of about 100 msecs) in which the degree of rotation of the DC motor reaches a predetermined degree of rotation (for example, four to five rotations). Accordingly, the resolution of the encoder can be reduced, thereby securing reductions in both the load of the control circuit and in manufacturing costs.

According to another aspect of the disclosure, there is provided a tape printer comprising: a tape conveyance mechanism having a DC motor as a drive source to convey a long tape; a detection device that repeatedly detects a drive time in which the DC motor reaches a predetermined degree of rotation; a first storage unit that preliminarily stores an initial print cycle; a print head that performs printing dot-pattern data on the tape conveyed by the tape conveyance mechanism; and a control circuit that drives and controls the print head, wherein the control unit comprises a processor that executes: a print starting process of starting drive of the print head at the initial print cycle and printing on the tape; a correction print cycle calculating process of repeatedly calculating a correction print cycle based on the drive time detected by the detection device after start of printing on the tape; and a print cycle correcting process of correcting the print cycle of the print head in accordance with the correction print cycle calculated at the correction print cycle calculating process.

Accordingly, even when the rotational speed of the DC motor changes due to the increase of a wire-wound resistance value because of the heat generation of the DC motor under the continuous driving and the load change by the replacement of the tape, the print cycle of the print head is corrected in each time when a degree of rotation of the DC motor reaches a predetermined degree of rotation, in the correction print cycle calculating process and the print cycle correction process. Thus, constant length of printing of a high quality can be achieved by the correction of the print cycle of the print head.

Further, measurement of the degree of rotation of the DC motor by means of the encoder in the correction print cycle calculating process is achieved by repeated detection of a drive time (for example, a drive time of about 100 msecs) in which the degree of rotation of the DC motor reaches a predetermined degree of rotation (for example, four to five rotations). Accordingly, the resolution of the encoder can be reduced, thereby securing reductions in both the load of the control circuit and in manufacturing costs.

According to another aspect of the disclosure, there is provided a tape creating method comprising: a print starting step of starting printing dot-pattern data on a conveyed tape at an initial print cycle preliminarily stored; a correction print cycle calculating step of repeatedly detecting a drive time in which a driving DC motor reaches a predetermined degree of rotation after start of printing on the tape, and repeatedly calculating a correction print cycle based on the detected drive time; and a print cycle correction step of correcting a print cycle in accordance with the correction print cycle calculated at the correction print cycle calculating step.

Accordingly, even when the rotational speed of the DC motor changes due to the increase of a wire-wound resistance value because of the heat generation of the DC motor under the continuous driving and the load change by the replacement of the tape, the print cycle of the print head is corrected in each time when a degree of rotation of the DC motor reaches a predetermined degree of rotation, in the correction print cycle calculating step and the print cycle correction step. Thus, constant length of printing of a high quality can be achieved by the correction of the print cycle of the print head.

Further, measurement of the degree of rotation of the DC motor by means of the encoder in the correction print cycle calculating step is achieved by repeated detection of a drive time (for example, a drive time of about 100 msecs) in which the degree of rotation of the DC motor reaches a predetermined degree of rotation (for example, four to five rotations). Accordingly, the resolution of the encoder can be reduced, thereby securing reductions in both the load of the control circuit and in manufacturing costs.

BRIEF DESCRIPTION OF THE DRAWINGS

FIG. 6 shows an example of a tape type correction table preliminarily stored in an EEPROM of the tape printer of FIG. 1;

FIG. 7 shows an example of the tape length correction table preliminarily stored in the EEPROM of the tape printer of FIG. 1;

DETAILED DESCRIPTION

A detailed description of an exemplary embodiment of a tape printer and a tape creating method of the disclosure will now be given referring to the accompanying drawings.

Figure 1:
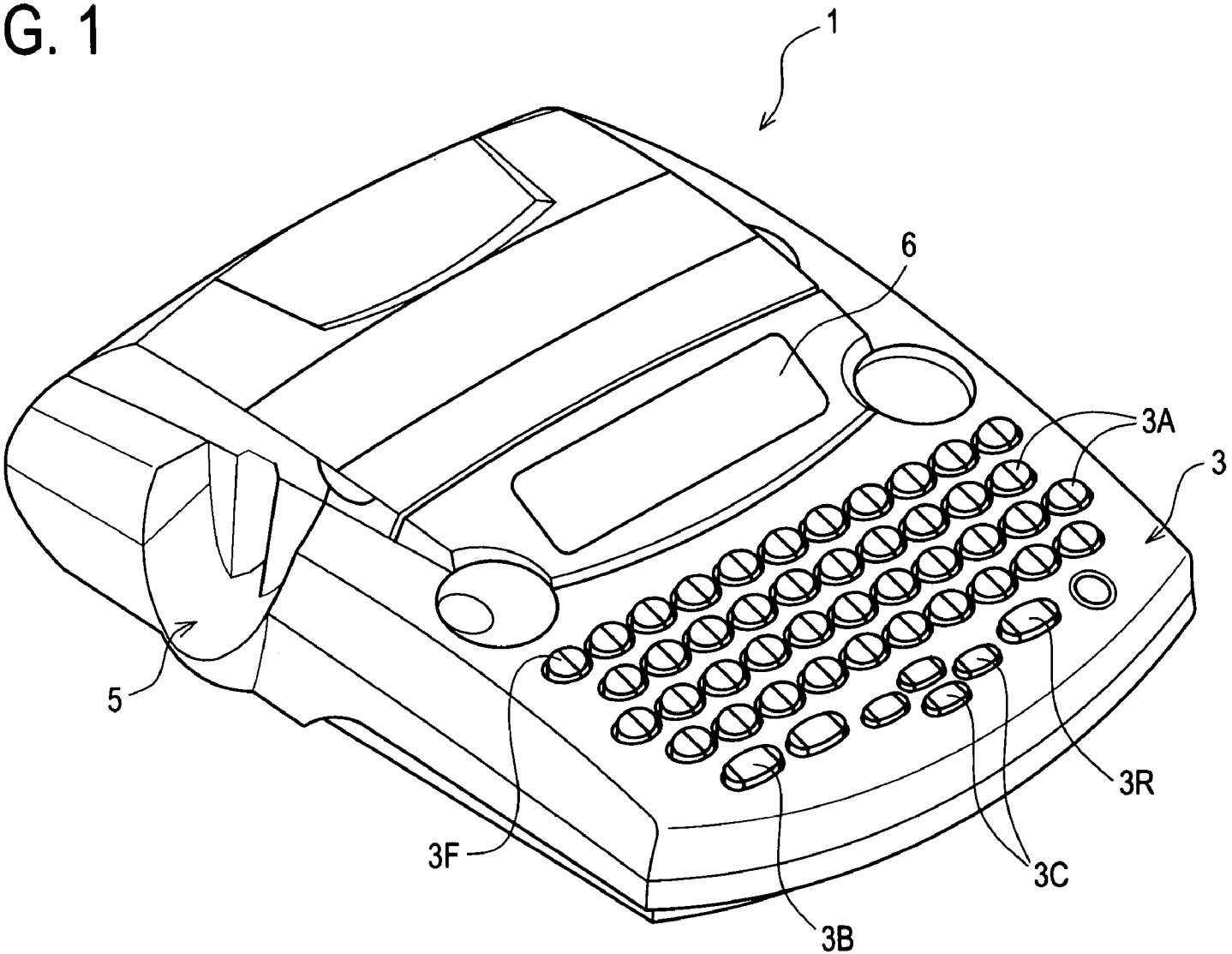
FIG. 1 is a perspective view of an appearance of a tape printer of an exemplary embodiment.

As shown in FIG. 1, a tape printer 1 of this exemplary embodiment has a keyboard 3 comprising a character input key 3A for creating a text composed of document data; a print key 3B for instructing printing of documents or other texts; a length correction key 3F for use in inputting a conveyance length correction value, to be described later; a return key 3R for executing or selecting a line feed instruction or a variety of processes; and cursor keys 3C for moving a cursor vertically and horizontally on a liquid crystal display (LCD) that displays plural lines of characters and the like. The tape printer 1 includes a tape storage cassette 30 (see FIG. 2), which is to be described later and which is freely detachable internally, and a tape drive print mechanism 10 and a cutter 17 (see FIG. 2) for cutting a tape. After extraction from the tape storage cassette 30 and printing, a tape is cut out by the cutter 17 and then discharged from a discharge port 5 provided on the left side face of the tape printer 1. A connection interface 67 (see FIG. 4) is provided on the right side face of the tape printer 1 for connecting it, by radio or wire, to an external device 78 such as a personal computer.

Figure 2:
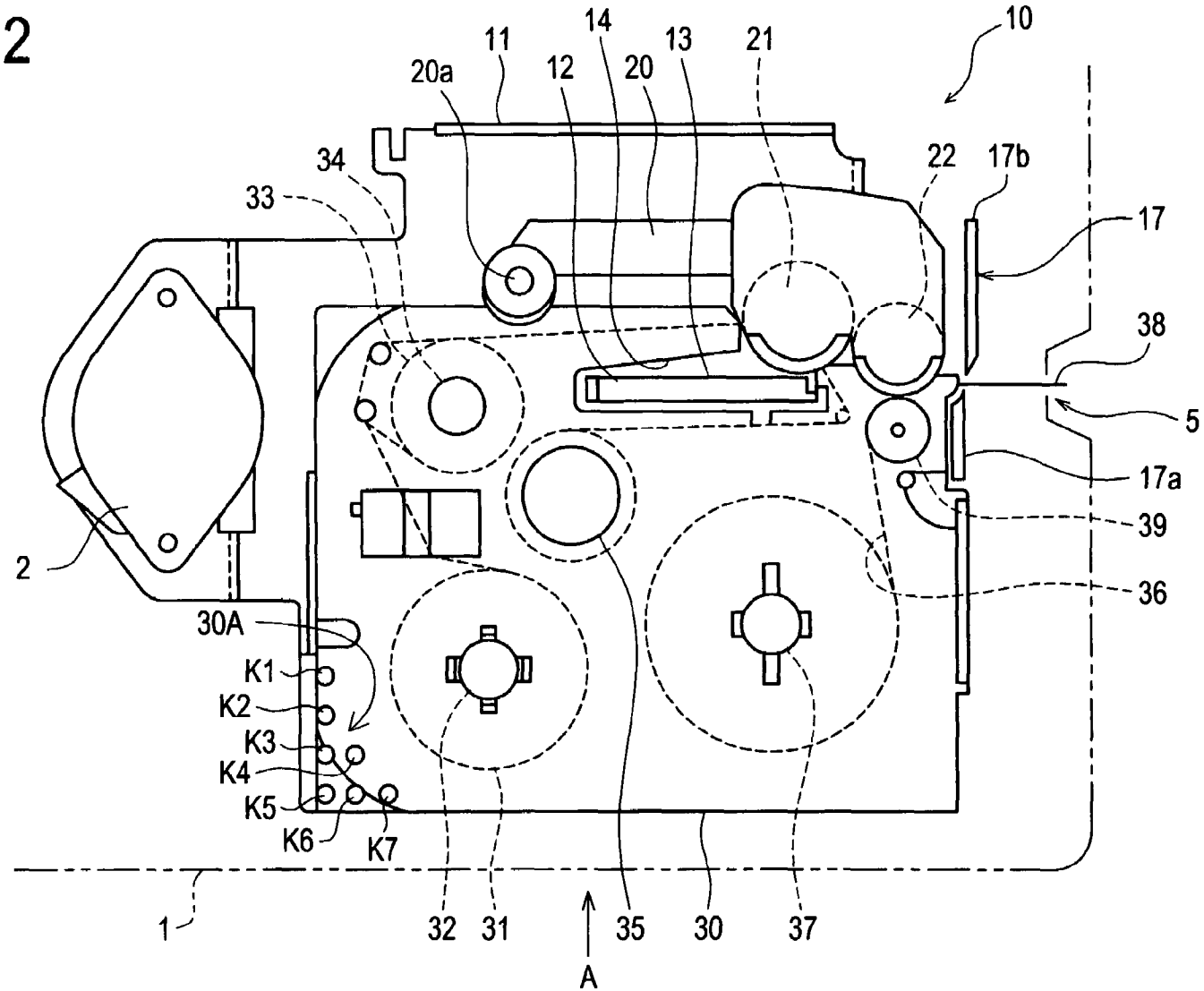
FIG. 2 is a plan view of a structure of a tape drive print mechanism and a tape storage cassette provided inside the tape printer of FIG. 1.

As shown in FIG. 2, the tape storage cassette 30 is mounted detachably in a cassette storage frame 11 within the tape printer 1. The tape storage cassette 30 includes a tape spool 32 around which a transparent surface tape 31 composed of polyethylene terephthalate (PET) is wound; a ribbon supply spool 34 around which an ink ribbon 33 is wound; a take-up spool 35 for winding up used ink ribbon 33, a base material supply spool 37 around which is wound a double-sided tape 36, in which a separation tape is bonded to a single face of the double-sided adhesive tape with an adhesive agent layer on both sides, and having the same width as the surface tape 31, such that the separation tape faces outward; and a press roller 39 for bonding together the double-sided tape 36 and the surface tape 31, these components being provided freely and rotatably.

Figure 3:
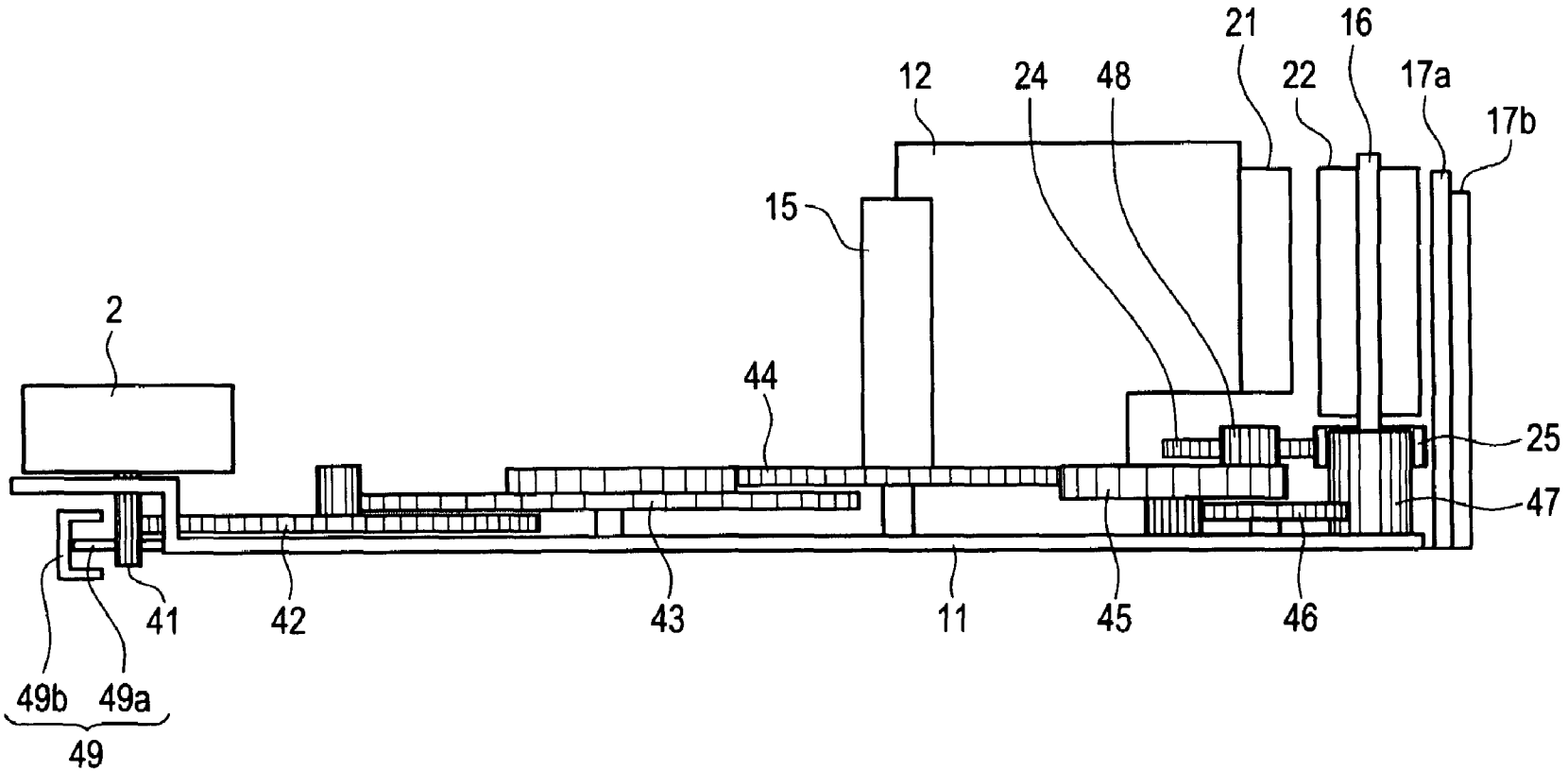
FIG. 3 is a side view of the tape drive print mechanism of FIG. 2 when the tape storage cassette is removed therefrom, seen from an arrow A direction.

As shown in FIGS. 2, 3, an arm 20 is mounted swingingly around a shaft 20*a* on the cassette storage frame 11. A platen roller 21 and a feed roller 22 having a flexible member such as rubber on their surfaces are rotatably provided at the front end of the arm 20. When the arm 20 is swung fully in a clockwise direction, the platen roller 21 makes a pressure contact, via the surface tape 31 and the ink ribbon 33, with a thermal head 13 disposed on a plate 12 to be described later and the feed roller 22 makes a pressure contact, via the surface tape 31 and the double-sided tape 36, with the press roller 39.

The plate 12 is erected from the cassette storage frame 11. The thermal head 13 in which a plurality of heat generating devices are arranged in line perpendicularly to this paper is disposed on the plate 12 on the platen roller 21 side. When the tape storage cassette 30 is mounted at a predetermined position, the plate 12 is embedded in a concave portion 14 in the tape storage cassette 30. As shown in FIG. 3, a ribbon take-up roller 15 and a press roller drive roller 16 are erected from the cassette storage frame 11. When the tape storage cassette 30 is mounted at a predetermined position, the ribbon take-up roller 15 and the press roller drive roller 16 are inserted into the take-up spool 35 and the press roller 39.

A tape driving DC motor 2 is mounted on the cassette storage frame 11. A rotary drive force driven out of an output shaft 41 of the DC motor 2 is transmitted to the ribbon take-up roller 15, the press roller drive roller 16, the platen roller 21 and the feed roller 22 via circular gears 42, 43, 44, 45, 46, 47, 48 disposed along the cassette storage frame 11 such that they mesh with each other, and circular gears 24, 25 are arranged so as to connect with the platen roller 21 and the feed roller 22.

Thus, when the DC motor 2 is supplied with electricity so that its output shaft 41 is rotated, the take-up spool 35, the press roller 39, the platen roller 21 and the feed roller 22 are all correspondingly rotated and the surface tape 31, the ink ribbon 33 and the double-sided tape 36 within the tape storage cassette 30 are unwound by a drive force generated by their rotations and carried downstream. The surface tape 31 and the ink ribbon 33 are overlapped each other and pass through, between the platen roller 21 and the thermal head 13. The surface tape 31 and the ink ribbon 33 are nipped between the platen roller 21 and the thermal head 13 and conveyed, and when a plurality of heat generating devices arranged on the thermal head 13 are supplied with electricity selectively and intermittently, ink on the ink ribbon 33 is transferred to the surface tape 31 in units of dots so as to form dot images desired as a mirror image. After the ink ribbon 33 passes the thermal head 13 and is wound up by the ribbon take-up roller 15, the surface tape 31 and the double-sided tape 36 are overlapped each other and pass through between the feed roller 22 and the press roller 39. Consequently, after dots have been printed thereon, a print side face of the surface tape 31 is overlapped with the double-sided tape 36.

A lamination tape 38 in which the surface tape 31 and the double-sided tape 36 have been overlapped one another allows a normal image of a printed image to be seen from the opposite side of the print face of the surface tape 31, and after it has been cut by the cutter 17 disposed downstream of the feed roller 22, it is discharged from the discharge port 5. The cutter 17 is constructed in the form of scissors in which a rotary blade 17*b* is rotated relative to a fixed blade 17*a* so as to cut out a object that needs to be cut, and the rotary blade 17*b* is swung around a fulcrum point by a DC motor 71 for the cutter (see FIG. 4) so as to cut out the lamination tape 38. The lamination tape 38 that is cut is available as an adhesive label and by the peeling of its separation tape this adhesive label can be bonded to any place so desired.

As shown in FIG. 3, the DC motor 2 is equipped with an encoder 49 as a sensor for detecting a degree of rotation thereof. The encoder 49 comprises a rotary disc 49*a* having slits spaced in a circumferential direction (nine slits are formed in this exemplary embodiment) and to which the output shaft 41 of the DC motor 2 is connected as a rotary shaft; and a photo sensor 49*b* in which a light emitting device and a light receiving device are disposed on both sides of the rotary disc 49*a* such that they oppose each other. Light beams emitted from the light emitting device of the photo sensor 49*b* are interrupted between the slits, or they pass through the slits in accordance with rotation of the circular disc 49*a*, and they reach the light receiving device.

A normal rotation or a reverse rotation of the DC motor 2 can be detected by using a single two-phase photo sensor instead of using the photo sensor 49*b* shown in FIG. 3.

The tape stored in the tape storage cassette 30 comprises four types, that is, a "lamination type" (see FIG. 2) in which the surface of the print tape is protected by a transparent film, a "receptor type" in which the surface of the print tape is not covered with protective tape, a "lettering type" in which the surface of the print tape is not covered with any protective film but designed with characters or patterns, and a "fabric type" in which the print tape is of fabric. Each of the four types of tapes has in turn six types in which the widths of tape are respectively 3.5 mm, 6 mm, 9 mm, 12 mm, 18 mm and 24 mm.

As shown in FIG. 2, there is provided a tape determination part 30A in which the presence/absence of seven sensor holes K1-K7 can be combined to detect the type or width of a stored tape on a corner between the top face portion and the bottom face portion of the tape storage cassette 30. A cassette sensor 7 (see FIG. 4) for detecting the presence or absence of each of the sensor holes K1-K7, made up of a push-type micro switch or the like, is provided on a bottom portion opposing the tape determination part 30A of the cassette storage frame 11. In other words, the cassette sensor 7 outputs cassette signals on the basis of the presence or absence of each of the sensor holes K1 to K7 that made up the tape determination part 30A. For example, a tape stored in the tape storage cassette 30 outputs a cassette signal "1011111" when the tape is 9 mm in width and of a lamination type, and "1100111" when the tape is of 9 mm width and of a receptor type; and when the tape storage cassette 30 is not attached the cassette sensor 7 outputs a cassette signal "0000000". Noted that "1" represents the ON signal, and "0" the OFF signal.

Figure 4:
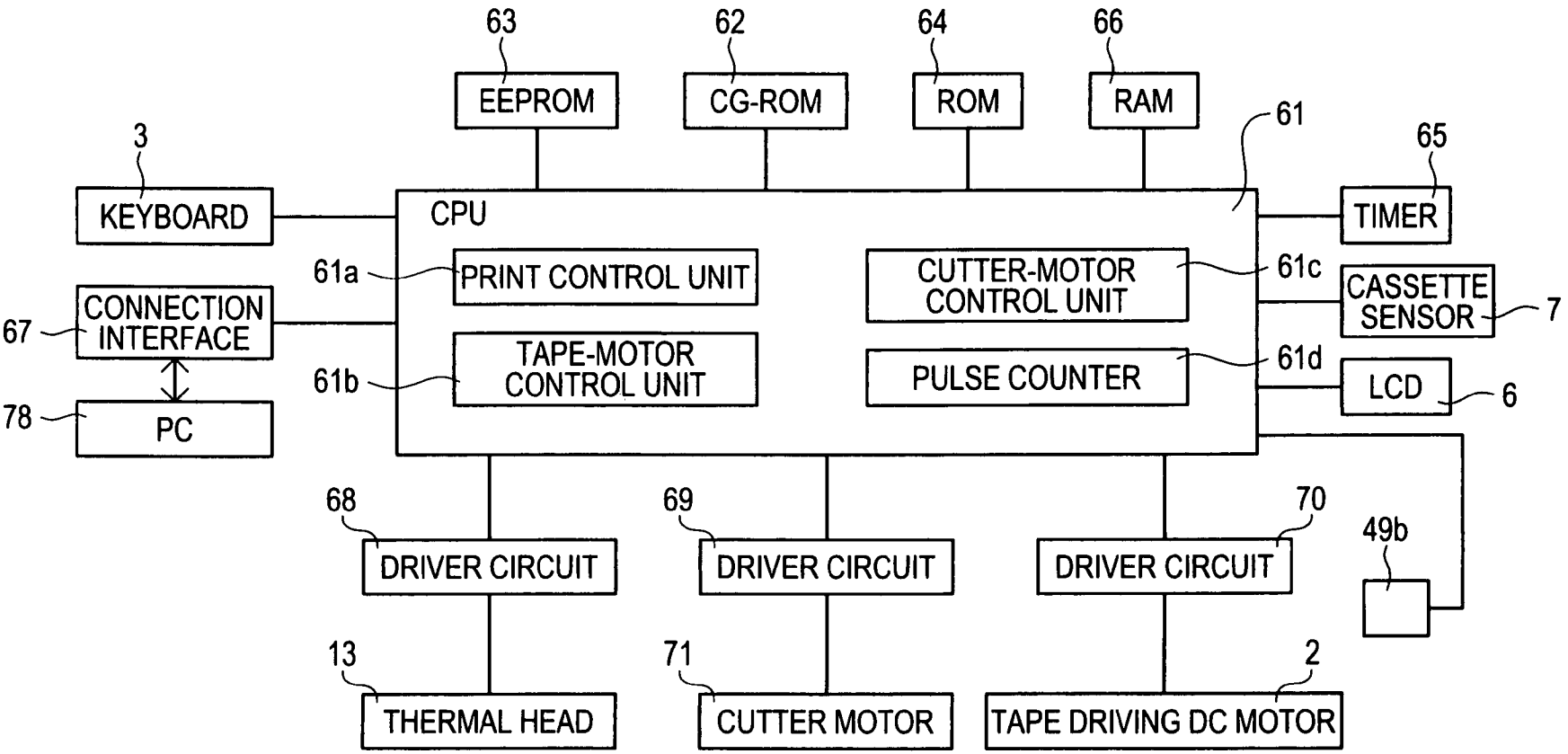
FIG. 4 is a block diagram of a control configuration of the tape printer of FIG. 1.

Next, the control configuration of the tape printer 1 will be described with reference to FIGS. 4, 5. Control boards (not shown) are disposed within the tape printer 1 and a CPU 61, CG-ROM 62, EEPROM 63, ROM 64, RAM 66, timer 65 and three driver circuits 68, 69, 70 are disposed on this control board. The CPU 61, which executes various arithmetical operations and controls input and output of signals, is connected to the CG-ROM 62, the EEPROM 63, the ROM 64, the RAM 66, the timer 65 and the driver circuits 68-70, and further to a liquid crystal display (LCD) 6, a cassette sensor 7, a photo sensor 49*b*, a keyboard 3 and a connection interface 67.

The CG-ROM 62 is a character generator memory which stores image data such as characters and symbols to be printed in a dot-pattern data corresponding to code data. The EEPROM 63 includes a tape type correction table 81 and a tape length correction table 82, both of which will be described later. The ROM 64 includes various types of data including programs for actuating the tape printer 1, an "initial print cycle" for driving a print operation of the thermal head, a "reference degree of rotation" of the DC motor 2 corresponding to the "initial print cycle" and a "shortest time" (about 10 milliseconds (hereinafter, "msecs") in this exemplary embodiment), which constitutes the shortest print control time require for forming print dots by means of the thermal head 13. The RAM 66 is provided with equipment such as a rotation correction cycle counter for counting clock signals until the degree of rotation of the DC motor 2 reaches a predetermined degree of rotation and stores data inputted through the keyboard 3, data that is brought in from an external device 78, through a connection interface 67, or the result of arithmetical operations in the CPU 61. Further, on the basis of a clock signal and as will be described later, the timer 65 measures a duration of time after the timer 65 has been initialized (see S7 in FIG. 9).

The CPU 61 comprises a print control unit 61*a* for controlling print by means of the thermal head 13, a tape-motor control unit 61*b* for controlling the ON and OFF of the DC motor 2, a cutter-motor control unit 61*c* for controlling the DC motor 71, and a pulse counter 61*d* for calculating from the output signal of the photo sensor 49*b* of the encoder 49, the quantity of rotational pulses of the DC motor 2. Further, with regard to a clock signal generated by the timer 65, the driver circuit 68 supplies a drive signal to the thermal head 13 on the basis of a control signal from the print control unit 61*a* at a corrected print cycle to be described later. Further, on the basis of a control signal from the cutter-motor control unit 61*c*, the drive circuit 69 supplies a drive signal to the DC motor 71. The drive circuit 70 drives the DC motor 2 on the basis of a control signal from the tape-motor control unit 61*b*.

Figure 5:
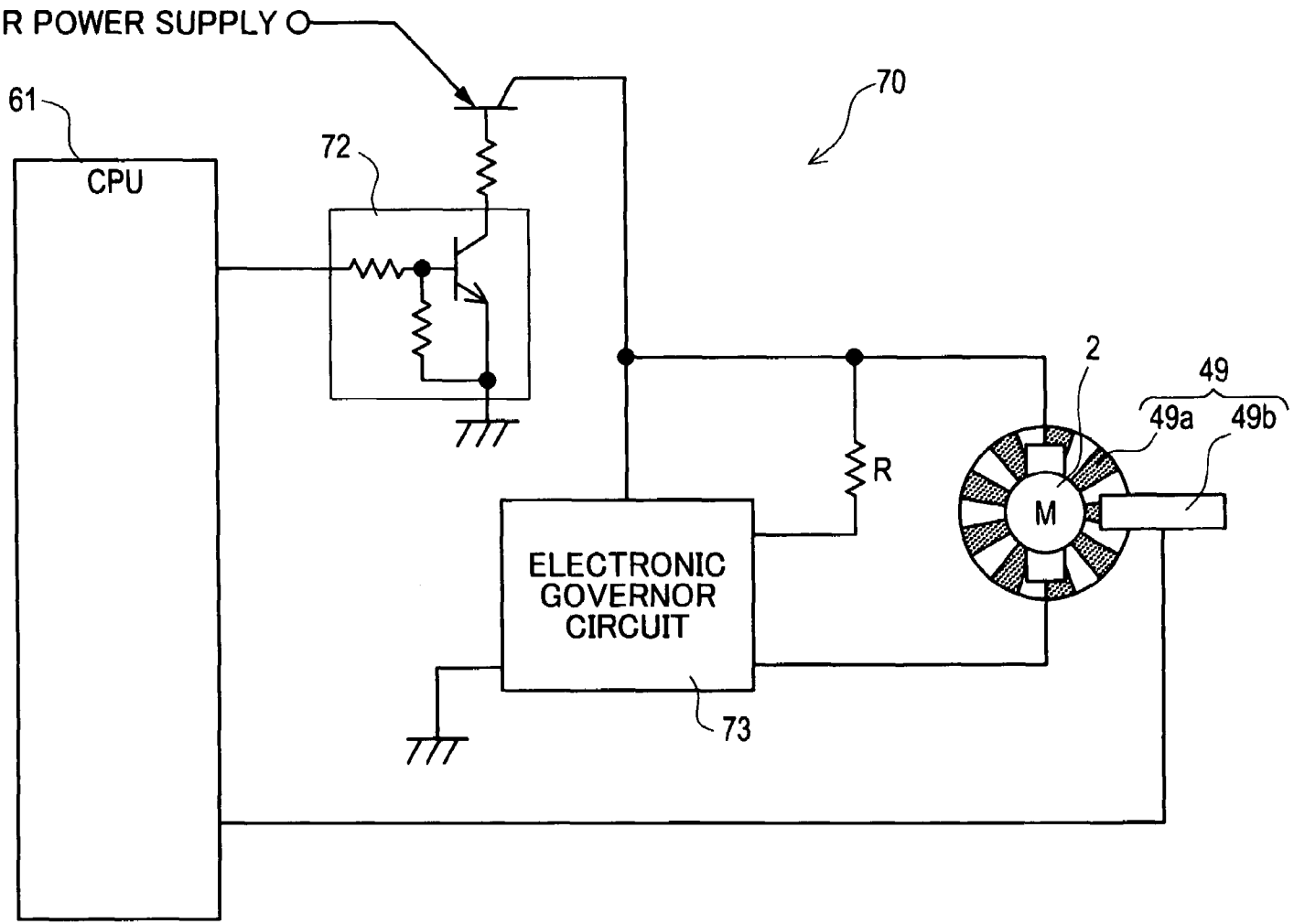
FIG. 5 is a schematic diagram of a driver circuit of a tape driving DC motor of the tape printer of FIG. 1.

As shown in FIG. 5, the driver circuit 70 for driving and controlling the DC motor 2 is provided with a switching transistor 72 which turns on and off supply of electricity to the DC motor 2 according to ON and OFF signals from the CPU 61 and an electronic governor circuit 73 for controlling the rotation of the DC motor 2 at a constant speed. This electronic governor circuit 73 executes proportional current control so that reverse electromotive force of the DC motor 2 becomes constant on the basis of current in a resistor R. Then, when a certain amount of time has elapsed following the start of the supply of electricity, regardless of the magnitude of the power supply voltage, the DC motor 2 succeeds in turning at a constant degree of rotation corresponding to a load of the DC motor 2. Then, a predetermined degree of rotation of the DC motor 2 (four rotations in this exemplary embodiment) is detected when a predetermined pulse number (36 pulses in this exemplary embodiment) is counted via the encoder 49.

Further, this electronic governor circuit 73 is a control IC, for example, LA5528N (manufactured by SANYO Electronic Co., Ltd.).

When the DC motor 2 is driven at a constant speed, the thermal head 13 is driven at a print cycle obtained by correcting the initial print cycle (T0) corresponding to factors such as the type of the tape stored in the tape storage cassette 30, as will be described later. After that, the thermal head 13 is driven at a correction print cycle corrected successively on the basis of a drive time in which each DC motor 2 reaches a predetermined degree of rotation. Thus, when a thermal head 13 starts its print operation, the ROM 64 stores data of the initial print cycle (T0) which is a reference print cycle. By driving the thermal head 13 at such a correction print cycle when the DC motor 2 runs at a constant speed, an adequate data process time (for example, development from outline font data to bit map data, character decoration, horizontal-to-vertical conversion) can be satisfactory secured for print data which is processed when the thermal head 13 is down, even when the DC motor 2 is being driven at a constant rotational speed of a substantial degree, thereby eliminating deteriorations in print quality such as occurrences printing errors.

On the other hand, the driving of the thermal head 13 is generally terminated on the basis of the output signal of the photo sensor 49*b* of the encoder 49 except for the period while the DC motor 2 drives at the constant speed (or equivalently, a period between the termination of the supply of electricity of the DC motor 2 and the stop of driving of the DC motor 2, and a period between the resumption of the supply of electricity of the DC motor 2 and the start of the driving of the DC motor 2 at the constant speed).

The tape type correction table 81 preliminarily stored in the EEPROM 63 will be described with reference to FIG. 6.

As shown in FIG. 6, the tape type correction table 81 comprises a "tape type" indicating the type of tape stored in the tape storage cassette 30, and a "tape type correction value" indicating a correction value for correcting the initial print cycle (T0) for driving the thermal head 13 corresponding to the tape type, by means of multiplying the initial print cycle (T0) by the correction value.

The "tape type" stores 12 combinations of types of tape and widths of tape ranging from 3.5 mm to 24 mm. For example, "3.5 mm, receptor" in "tape type" indicates that the width of the tape is 3.5 mm and that the tape is of a "receptor type". Further, "6 mm, laminate" in "tape type" indicates that the width of the tape is 6 mm and that the type of tape is "lamination type".

The "tape type correction value" stores a numeral "1" for seven types of "3.5 mm, receptor", "6 mm, receptor", "9 mm, receptor" and the like in terms of "tape type". The "tape type correction value" stores a numeral "0.985" for each of five types of "6 mm, laminate", "9 mm, laminate", "12 mm, laminate" and the like in terms of "tape type". In other words, the five types of initial print cycles of "6 mm, laminate", "9 mm, laminate", "12 mm, laminate" and the like in terms of "tape type" are corrected so that the initial print cycle of the thermal head 13 is slightly shorter, as will be described later (see S2 in FIG. 9).

Next, the tape length correction table 82 stored in the EEPROM 63 will be described with reference to FIG. 7.

As shown in FIG. 7, the tape length correction table 82 comprises a "conveyance length correction value" indicating the amount of correction of the tape conveyance length which can be changed selectively by a user when the tape conveyance length relative to a degree of rotation of the DC motor 2 changes as a result of factors such as friction of the platen roller 21, and a "tape length correction value" corresponding to the "conveyance length correction value" and indicating a correction value for correcting a print cycle (T) at which the thermal head is driven by means of multiplying the print cycle (T) by the correction value.

Further, the "conveyance length correction value" stores "+3" indicating that the tape conveyance length is increased by about 3%, "+2" indicating that the tape conveyance length is increased by about 2%, "+1" indicating that the tape conveyance length is increased by about 1%, "0" indicating that the tape conveyance length is not changed and "−1" indicating that the tape conveyance length is decreased by about 1%.

Further, the "tape length correction value" stores "1.03" corresponding to "+3" of the "conveyance length correction value", "1.02" corresponding to "+2" of the "conveyance length correction value", "1.01" corresponding to "+1" of the "conveyance length correction value", "1" corresponding to "0" of the "conveyance length correction value" and "0.99" corresponding to "−1" of the "conveyance length correction value". Therefore, the print cycle of the thermal head 13 is corrected in accordance with the "conveyance length correction value" selected by a user, as will be described later (see FIG. 10).

Next, an explanation will be given, on the basis of FIG. 8 of operations undertaken by a user to select a conveyance length selection value.

Figure 8:
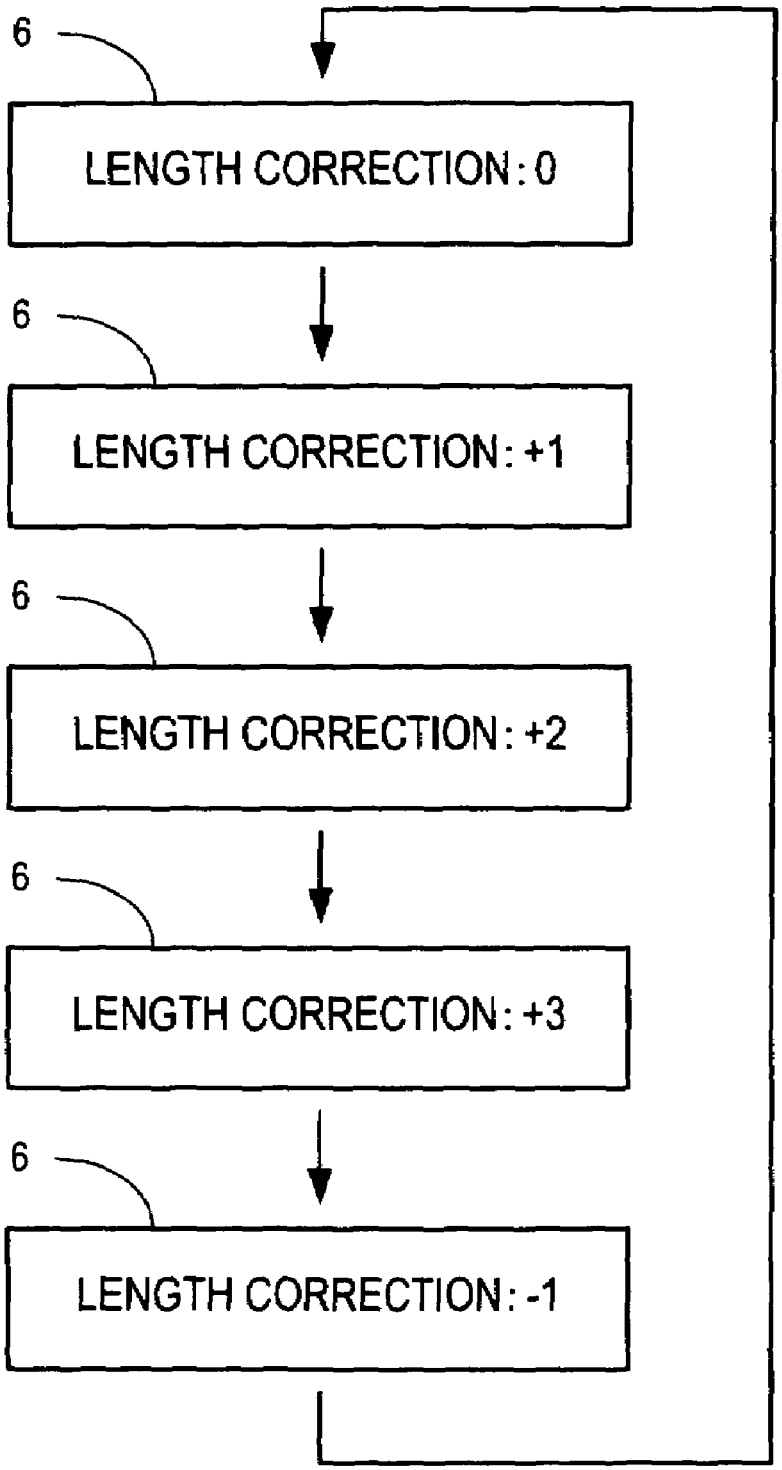
FIG. 8 shows an example of a display of a liquid crystal display when a length correction key of the tape printer of FIG. 1 is pressed.

When a user presses a length correction key 3F of the keyboard 3, as shown in FIG. 8, "length correction: 0" is first displayed on the liquid crystal display (LCD) 6, indicating that, "0" has been selected as the "conveyance length correction value". Then, when a user presses a return key 3R, "0" is stored in the EEPROM 63 as the "conveyance length correction value" and the liquid crystal display 6 is returned to the character input mode.

On the other hand, if a user presses the length correction key 3F repeatedly, the liquid crystal display 6 displays in succession "length correction +1" indicating that "+1" has been selected as the "conveyance length correction value", "length correction: +2" indicating that "+2" has been selected as the "conveyance length correction value", "length correction: +3" indicating that "+3" has been selected as the "conveyance length correction value", and "length correction: −1" indicating that "−1" has been selected as the "conveyance length correction value", and when the length correction key 3F is pressed, the display is returned to "length correction: 0" indicating that "0" has been selected as the "conveyance length correction value". Then, if a user presses the return key 3R when any display is on, any one of "+1", "+2", "+3", "−1", and "0" can be stored in the EEPROM 63 as the "conveyance length correction value" corresponding to the indication on the liquid crystal display 6, and the liquid crystal display 6 is then returned to the character input mode. Furthermore, "0" is stored in the EEPROM 63 as the "conveyance length correction value" at the time of shipment from the factory.

The print control process for printing on a tape of the tape printer 1 having such a configuration items such as character data will be described with reference to FIGS. 9-12.

Figure 9:
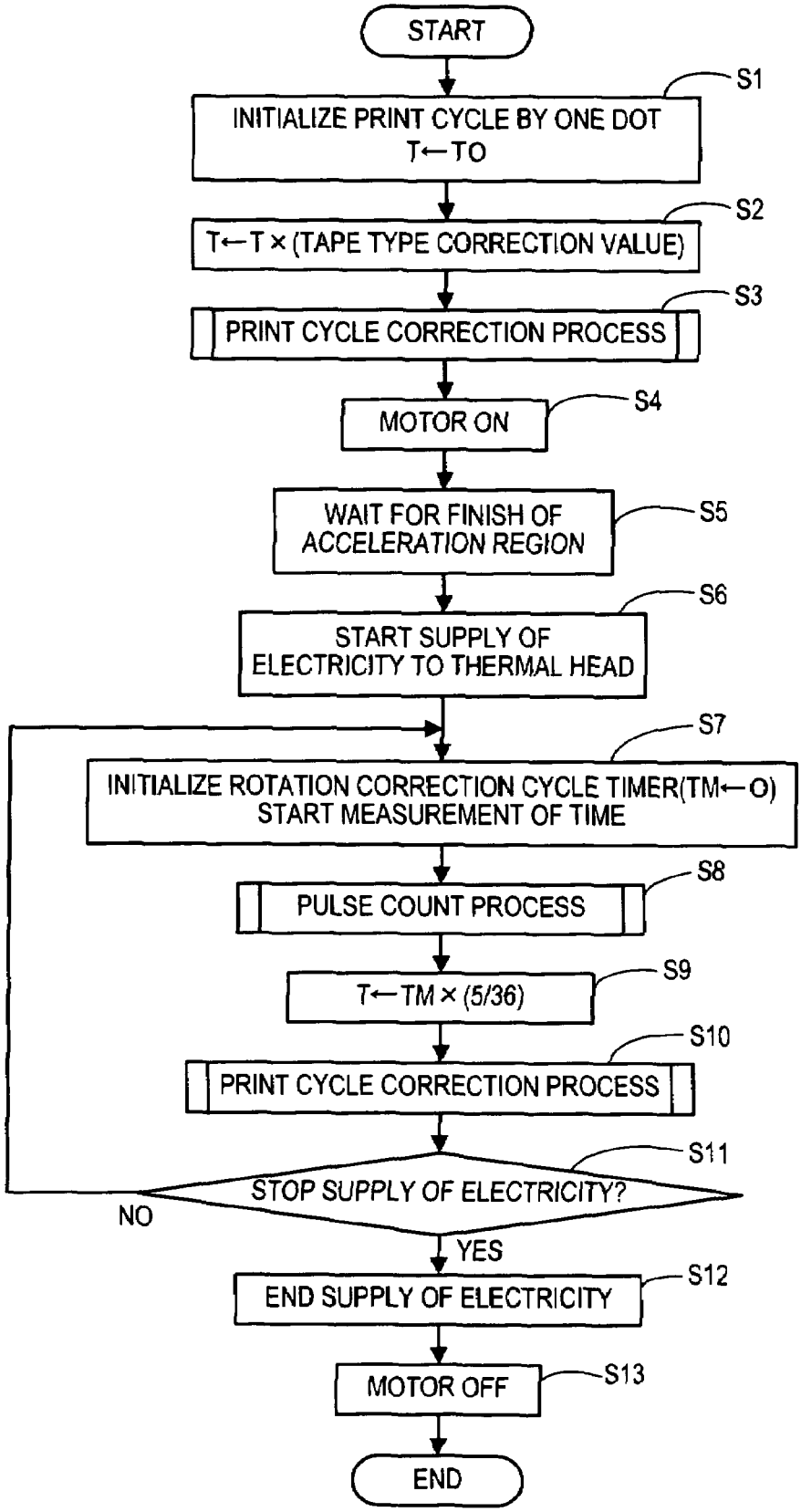
FIG. 9 is a main flowchart of a print control process of the tape printer of FIG. 1.

As shown in FIG. 9, in step (hereinafter abbreviated to S) 1, when the print key 3B of the keyboard 3 is pressed, the CPU 61 of the tape printer 1 reads out the initial print cycle (T0) (T0=14.1 msecs corresponds to about 5 pulses of the photo sensor 49*b* in this exemplary embodiment) and this initial print cycle (T0) is substituted for a print cycle algebra T and its result stored in the RAM 66.

In S2, the CPU 61 defines, by means of the cassette sensor 7, the type and width of the tape stored in the tape storage cassette 30. Applying the type and width of the tape to a "tape type" in the tape type correction table 81 stored in the EEPROM 63, the CPU 62 reads out a "tape type correction value" corresponding to the "tape type". Then, the CPU 61 reads out from the RAM 66 the print cycle algebra T and stores again a value produced in the RAM 66 by multiplying this print cycle algebra T by the "tape type correction value" as a new print cycle algebra T.

For example, if a cassette signal of "1011111" is inputted to the CPU 61 from the cassette sensor 7, the CPU 61 specifies that the tape stored in the tape storage cassette 30 has a width of 9 mm and is of a lamination type, and accordingly reads out a "tape type correction value" of "0.985" corresponding to "9 mm, laminate" in the "tape type" stored in the tape type correction table 81. Then, the CPU 61 reads out from the RAM 66 the print cycle algebra T and again stores a value obtained in the RAM 66 by multiplying this print cycle algebra T by "0.985" as the print cycle algebra T.

If a cassette signal of "1100111" is inputted to the CPU 61 from the cassette sensor 7, the CPU 61 determines that the tape stored in the tape storage cassette 30 has a width of 9 mm and is of receptor type, and reads out in the tape type correction table 81 "1" of "tape type correction value" corresponding to "9 mm, receptor" of the "tape type". Then, the CPU 61 reads out a print cycle algebra T from the RAM 66 and again stores into the RAM 66 a value obtained in the RAM 66 by multiplying this print cycle algebra T by "1" as a new print cycle algebra T.

Subsequently, in S3, the CPU 61 executes sub-process of the "print cycle correction process" which will be described later (see FIG. 10).

In S4, the CPU 61 turns on the switching transistor 72 so as to start supply of electricity to the DC motor 2. As a consequence, the electronic governor circuit 73 executes proportional current control on the DC motor 2 so that a reverse electromotive force of the DC motor 2 becomes constant.

In S5, by detecting a pulse cycle from the photo sensor 49*b* the CPU 61 waits for the DC motor 2 to finish its acceleration region and reaches its constant rotational speed. It is noted that the CPU 61 can wait for a predetermined period of time after the DC motor 2 has been started.

In S6, the CPU 61 reads out from the RAM 66 the print cycle algebra T at a timing at which the rotational speed of the DC motor 2 reaches a constant speed and, by means of the thermal head 13 with this print cycle algebra T as a print cycle (T) for driving the thermal head 13, starts line printing on the surface tape 31 at each print cycle (T). Consequently, dot-pattern data is printed on the surface tape 31 at intervals of dots corresponding to a conveyance distance of a tape conveyed in the print cycle (T). Because, as will be described later, this print cycle algebra T is corrected in each time when a pulse number inputted from the photo sensor 49*b* reaches a control pulse number (36 pulses corresponding to four turns of the DC motor 2 in this exemplary embodiment), the CPU 61 reads out the print cycle algebra T from the RAM 66 in each time when the print cycle algebra T is corrected and with this print cycle algebra T as a print cycle (T) for driving the thermal head 13 executes, by means of the thermal head 13, line printing on the surface tape 31 at each print cycle.

After the initialization of the timer 65 as a rotation correction cycle timer in S7, the CPU 61 reads out a measurement time TM of the timer 65, "0" is substituted for the measurement time TM, and its result is again stored in the timer 65. After that, the timer 65 starts to measure time so as to start measurement of a time for the degree of rotation of the DC motor 2 so as to reach a predetermined degree of rotation (four turns, corresponding to 36 pulses of the photo sensor 49*b* in this exemplary embodiment).

In S8, the CPU 61 executes the sub-process of the "pulse count process" which will be described later (see FIG. 11).

Subsequently, in S9, when the count value of the pulse counter 61*d* reaches a number of control pulses, the CPU 61 reads out the measurement time TM of the timer 65, and stores the measurement time TM into the RAM 66. Then, the CPU 61 again reads out from the RAM 66 the measurement time TM and reads out a reference encoder pulse number (in this exemplary embodiment, the initial print cycle (T0) is 14.1 msecs and a reference encoder pulse number is 5 pulses), and a control pulse number (in this exemplary embodiment, 36 pulses of the photo sensor 49*b* corresponds to four turns of the DC motor 2). The CPU 61 computes the "correction print cycle" by multiplying the measurement time TM by a rate of the reference encoder pulse number relative to the control pulse number. Then, the CPU 61 reads out from the RAM 66 the print cycle algebra T substitutes this "correction print cycle" for this print cycle algebra T, and the result is again stored in the RAM 66 as a new print cycle algebra T.

After that, in S10, the CPU 61 executes the sub-process (see FIG. 10) of the "print cycle correction process" described in S3 above.

Subsequently, in S11, the CPU 61 executes determination process, a process of determining whether or not supply of electricity to the thermal head 13 has been stopped, that is, whether or not all the print data stored in the RAM 66 has been printed. Then, unless all the print data stored in the RAM 66 has been printed (S11: NO), the CPU 61 again executes a process subsequent to S7.

On the other hand, if all the print data stored in the RAM 66 has been printed (S11: YES), in S12 the CPU 61 terminates the driving of the thermal head 13.

In S13, the CPU 61 turns off the switching transistor 72 so as to turn off supply of electricity to the DC motor 2 and then terminates the process.

Next, the sub-process of the "print cycle correction process" executed in S3 and S10 described above will be described with reference to FIG. 10.

Figure 10:
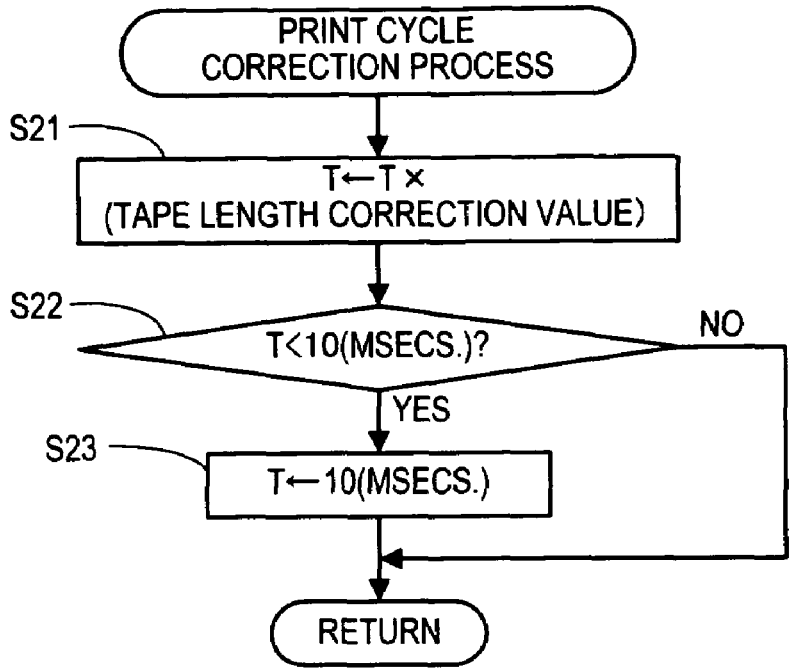
FIG. 10 is a sub-flowchart of a print cycle correction process of FIG. 9.

In S21, as shown in FIG. 10, the CPU 61 reads out the conveyance length correction value stored in the EEPROM 63. Applying the conveyance length correction value as a "conveyance length correction value" stored in the tape length correction table 82 stored in the EEPROM 63, the CPU 61 reads out the "tape length correction value" corresponding to the "conveyance length correction value". Then, the CPU 61 reads out the print cycle algebra T from the RAM 66, and again stores into the RAM 66, a value obtained by multiplying this print cycle algebra T by the "tape length correction value" as a new print cycle algebra T.

For example, if the "conveyance length correction value" read out from the EEPROM 63 is "0", the CPU 61 reads out "1" of the "tape length correction value" corresponding to "0" of the "conveyance length correction value" in the tape length correction table 82 stored in the EEPROM 63. Then, the CPU 61 reads out from the RAM 66 the print cycle algebra T and again stores into the RAM 66 a value obtained in the RAM 66 by multiplying this print cycle algebra T by "1" as a new print cycle algebra T.

If the "conveyance length correction value" read out from the EEPROM 63 is "+1", the CPU 61 reads out from the tape length correction table 82 stored in the EEPROM 63 "1.01" of the "tape length correction value" corresponding to "+1" of the "conveyance length correction value". Then, the CPU 61 reads out from the RAM 66 the print cycle algebra T and again stores into the RAM 66 a value obtained in the RAM 66 by multiplying this print cycle algebra T by "1.01" as a new print cycle algebra T.

Subsequently, in S22, the CPU 61 reads out from the ROM 64 the "shortest time" of the print cycle, that is, "10 msecs" which is the "shortest time" data of the shortest print control time required for the thermal head 13 to form print dots. The CPU 61 further reads out from the RAM 66 the print cycle algebra T and executes determination process for determining whether or not this print cycle algebra T is less than 10 msecs.

If the print cycle algebra T is less than 10 msecs (S22: YES), the CPU 61 proceeds to a process of S23. In S23, the CPU 61 again reads out from the RAM 66 the print cycle algebra T, substitutes 10 msecs for this print cycle algebra T. After a new print cycle algebra T is stored in the RAM 66, the CPU 61 terminates this sub-process and then returns to the main flow chart.

On the other hand, if the print cycle algebra T is equal to or more than 10 msecs (S22: NO), the CPU 61 terminates the sub-process and returns to the main flow chart.

Next, sub-process on the "pulse count process" to be executed in S8 will be described with reference to FIG. 11.

Figure 11:
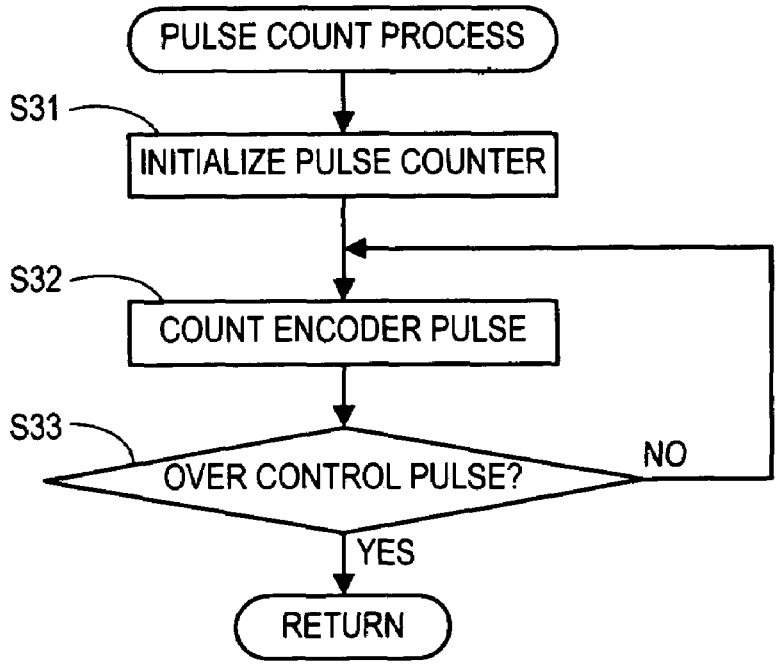
FIG. 11 is a sub-flowchart of a pulse count process of FIG. 9.

As shown in FIG. 11, in S31, the CPU 61 initializes the pulse counter 61*d*.

In S32, the CPU 61 detects a pulse inputted through the photo sensor 49*b*, and if a pulse is detected, it reads out a count value from the pulse counter 61*d*, adds "1" to that count value and memorizes its result in the pulse counter 61*d*.

Subsequently, in S33, the CPU 61 reads out a count value of the pulse counter 61*d* and at the same time, reads out from the ROM 64 a number of control pulses so as to execute determination process, the processes of determining whether or not the count value becomes equal to or exceeds the number of control pulses (in this exemplary embodiment, 36 pulses equivalent to four rotations of the DC motor 2). If the count value of the pulse counter 61*d* is less than the number of control pulses (S33: NO), the CPU 61 again executes process subsequent to S32.

On the other hand, if the count value of the pulse counter 61*d* becomes equal to or exceeds the number of control pulses, that is, the count value of the pulse counter 61*d* reaches the number of control pulses (S33: YES), the CPU 61 terminates this sub-process and returns to the main flow chart.

Figure 12:
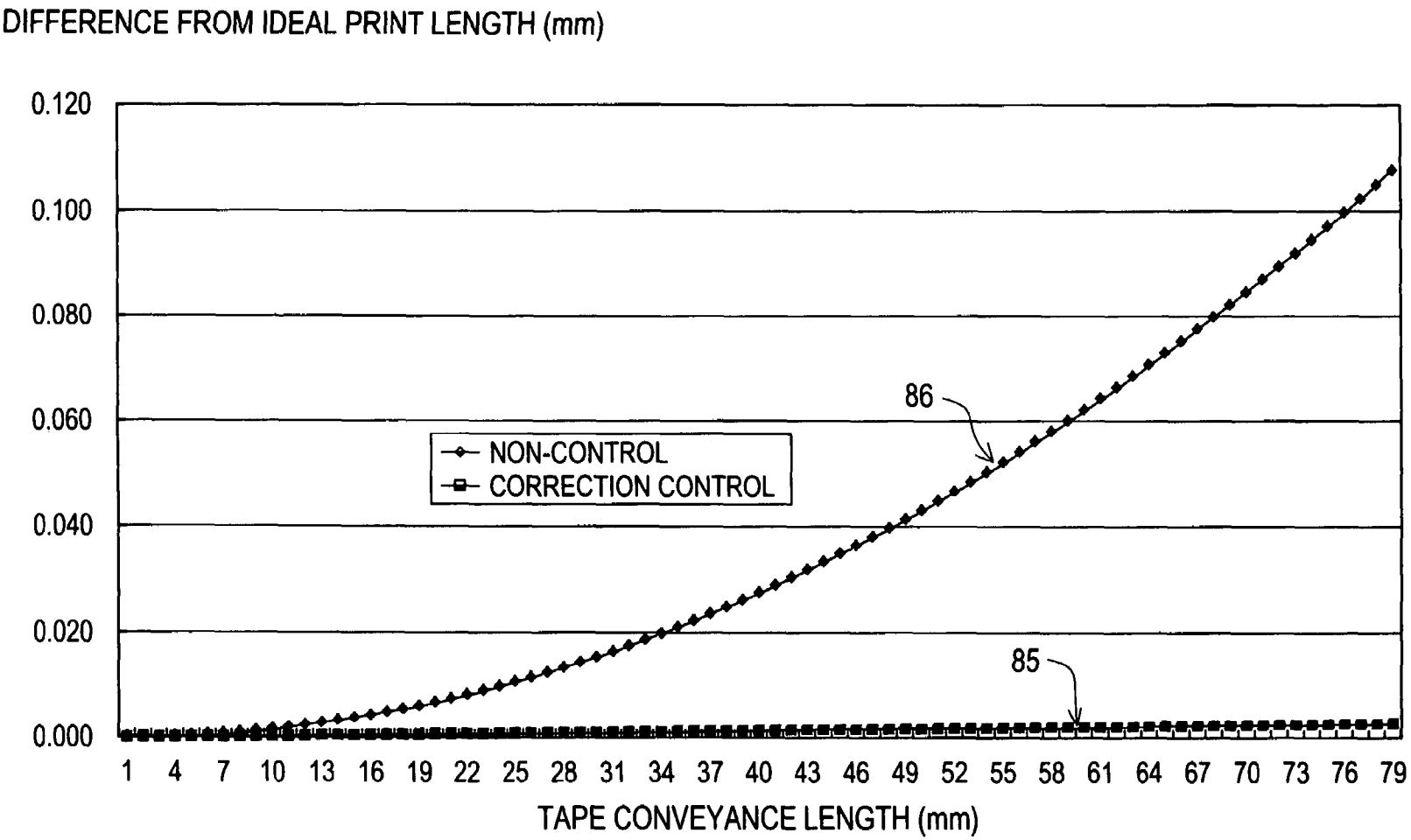
FIG. 12 shows an example of differences of the print lengths from ideal print length that does not cause tape conveyance errors, specifically a case where, by execution of print control process of FIG. 9, the print cycle is corrected successively at every four rotations of the DC motor and a case of non-control, in which the print cycle is not corrected successively at every four rotations of the DC motor.

FIG. 12 shows an example of differences of the print lengths from ideal print length that does not cause tape conveyance errors, specifically a case where, by execution of print control process (S1-S13), the print cycle is corrected successively at every four rotations of the DC motor 2 and a case of non-control, in which the print cycle is not corrected successively at every four rotations of the DC motor 2.

Noted that the initial print cycle (T0) of the thermal head 13 is 14.1 msecs. The quantity of slits formed in the rotating disc 49*a* of the encoder 49 is 9 and the photo sensor 49*b* outputs 9 pulses per rotation. Therefore, the print cycle of the thermal head 13 is corrected at every 36 pulses (number of control pulses) of the photo sensor 49*b*. The reference rotational speed of the DC motor 2 is a rotational speed of 1 revolution per 14.1×9÷5=25.38 msecs. When the DC motor 2 is rotated regularly, at every 36 pulses of the photo sensor 49*b* the tape is conveyed about 1 mm. Further, the DC motor 2 generates a rotational speed error of 0.004% at every pulse of the photo sensor 49*b*.

If the print control process (S1-S13) described above is executed as shown in FIG. 12 so as to correct the print cycle successively at every four rotations of the DC motor 2, a difference with respect to an ideal print length changes as indicated by a correction error curve 85, so that when a tape is conveyed about 80 mm, an error of about 0.0026 mm occurs.

On the other hand, unless process of S7-S10 is executed during the print control process (S1-S13), that is, unless the print cycle is corrected at every four rotations of the DC motor 2, the difference with respect to the ideal print length changes as indicated by the non-control error curve 86, so that an error of about 0.11 mm occurs when the tape is conveyed about 80 mm.

Therefore, in the tape printer 1 of this exemplary embodiment, if the rotational speed of the DC motor 2 while printing on the tape at a constant speed changes due to increase of a wire-wound resistance value because of heat generation of the DC motor 2 under continuous driving, and load change depending on the tape type, the print cycle algebra T is corrected in every time when the quantity of pulses of the photo sensor 49*b* for detecting the degree of rotation of the DC motor 2 reaches a number of control pulses (in this exemplary embodiment, 36 pulses corresponding to four rotations of the DC motor) (S9).

Accordingly, line printing on the surface tape 31 is carried out by the thermal head 13 at every print cycle (T) which is applied the print cycle algebra T for driving the thermal head 13, so that a high degree of accuracy and constant length of printing of a high quality can be achieved by correction of the print cycle (T) of the thermal head 13, even when the rotational speed of the DC motor 2 changes.

Measurement of the degree of rotation of the DC motor 2 by means of the encoder 49 is achieved by detecting the quantity of control pulses (in this exemplary embodiment, 36 pulses equivalent to four rotations of the DC motor 2) corresponding to a drive time (for example, a drive time of about 100 msecs) in which the degree of rotation of the DC motor 2 reaches a predetermined degree of rotation (for example, four to five rotations). Accordingly, the resolution of the encoder 49 can be reduced, thereby securing reductions in both the load of the control circuit and in manufacturing costs. Repeated detections of the control pulse are permitted to be achieved at the same time in parallel, by shifting them in terms of time, and in this case, smooth correction of the print cycle (T) becomes possible.

Before the drive of the DC motor 2 is started, a tape type correction value corresponding to the type of tape detected by the cassette sensor 7 is corrected by multiplying the initial print cycle (T0) by the tape type correction value, and then stored in the RAM 66 as the print cycle algebra T (S2). Thus, even when the rotational speed of the DC motor 2 changes when the tape storage cassette 30 is replaced by another tape storage cassette containing a different type of tape, a high degree of accuracy and constant length of printing of a high quality can be achieved by correction of the print cycle (T) of the thermal head 13.

Before the drive of the DC motor 2 is started, a tape length correction value corresponding to the conveyance length correction value specified by the length correction key 3F and the return key 3D is corrected by multiplying the print cycle algebra T for which the initial print cycle (T0) has been substituted (S3) by the conveyance length correction value and this tape length correction value is corrected by multiplying the print cycle algebra T in which the correction print cycle has been substituted by this tape length correction value (S10). As a result, when a user specifies a conveyance length correction value, the print cycle algebra T is automatically corrected when the thermal head 13 starts printing, and in each time when the pulse number reaches the control pulse number. Thus, even when a tape conveyance length corresponding to the degree of rotation of the DC motor 2 changes as a result of friction of the platen roller 21, a high degree of accuracy and constant length of printing of a high quality can be achieved by correction of the print cycle of the thermal head 13.

If the print cycle algebra T turns to the "shortest time" of the print cycle, that is, "shortest time" which is the shortest print control time required for forming print dots by means of the thermal head 13, which is less than "10 msecs" (S22: YES), the print cycle algebra T is read out from the RAM 66, "10 msecs" is substituted for this print cycle algebra T and its result is stored in the RAM 66 (S23). Thus, because the shortest print control time (10 msecs in this exemplary embodiment) required for forming the print dots by means of the thermal head 13 can be secured, unevenness of print dots due to extreme rotational changes of the DC motor 2 can be prevented by correcting the print cycle, thereby making possible a higher quality of printing.

While the presently exemplary embodiment has been shown and described, it is to be understood that this disclosure is for the purpose of illustration and that various changes and modifications may be made without departing from the scope of the disclosure as set forth in the appended claims.

What is claimed is:

1. A tape printer comprising:

a tape conveyance mechanism having a DC motor as a drive source to convey a long tape;

a detection device that repeatedly detects a drive time in which the DC motor reaches a predetermined degree of rotation;

a first storage unit that preliminarily stores an initial print cycle;

a correction print cycle calculating unit that calculates a correction print cycle based on the drive time detected by the detection device;

a print head that performs printing dot-pattern data on the tape conveyed by the tape conveyance mechanism; and a print control unit that drives and controls the print head, wherein the print control unit drives and controls the print head at the initial print cycle and the correction print cycle calculated by the correction print cycle calculating unit.

2. The tape printer according to claim 1, comprising:

a tape type detection device that detects a type of the tape; and a second storage unit that preliminary stores a tape type correction value for correcting a print cycle of the print head corresponding to the type of the tape, wherein the print control unit corrects the initial print cycle based on the tape type correction value corresponding to the type of the tape detected by the tape type detection device before start of driving of the DC motor.

3. The tape printer according to claim 1, comprising:

a third storage unit that stores plural kinds of conveyance length correction values for correcting a tape conveyance length relative to the degree of rotation of the DC motor, and tape length correction values for correcting the print cycle of the print head corresponding to the conveyance length correction values;

a specification mechanism that specifies one of the plural kinds of conveyance length correction values, wherein the print control unit corrects the initial print cycle based on the one tape length correction value corresponding to the conveyance length correction value specified by the specification mechanism before start of driving of the DC motor, and the correction print cycle calculating unit corrects the correction print cycle based on the one tape length correction value.

4. The tape printer according to claim 1, comprising:

a fourth storage unit that stores a shortest time of the print cycle, wherein the correction print cycle calculating unit corrects the correction print cycle again by substituting the shortest time for the correction print cycle when the correction print cycle is less than the shortest time.

5. A tape printer comprising:

a tape conveyance mechanism having a DC motor as a drive source to convey a long tape;

a detection device that repeatedly detects a drive time in which the DC motor reaches a predetermined degree of rotation;

a first storage unit that preliminarily stores an initial print cycle;

a print head that performs printing dot-pattern data on the tape conveyed by the tape conveyance mechanism; and a control circuit that drives and controls the print head, wherein the control circuit comprises a processor that executes:

a print starting process of starting drive of the print head at the initial print cycle and printing on the tape;

a correction print cycle calculating process of repeatedly calculating a correction print cycle based on the drive time detected by the detection device after start of printing on the tape; and a print cycle correcting process of correcting the print cycle of the print head in accordance with the correction print cycle calculated at the correction print cycle calculating process.

6. The tape printer according to claim 5, comprising:

a tape type detection device that detects a type of the tape; and a second storage unit that preliminary stores a tape type correction value for correcting the print cycle of the print head corresponding to the type of the tape, wherein the processor executes a first initial print cycle correction process of correcting the initial print cycle based on the tape type correction value corresponding to the type of the tape detected by the tape type detection device before start of driving of the DC motor.

7. The tape printer according to claim 5, comprising:

a third storage unit that stores plural kinds of conveyance length correction values for correcting a tape conveyance length relative to the degree of rotation of the DC motor, and tape length correction values for correcting the print cycle of the print head corresponding to the conveyance length correction values; and a specification mechanism that specifies one of the plural kinds of conveyance length correction values, wherein the processor executes:

a second initial print cycle correction process of correcting the initial print cycle based on the one tape length correction value corresponding to the conveyance length correction value specified by the specification mechanism before start of driving of the DC motor, and a tape length correction process of correcting the correction print cycle based on the one tape length correction value corresponding to the conveyance length correction value specified by the specification mechanism at the print cycle correction process.

8. The tape printer according to claim 5, comprising:

a fourth storage unit that stores a shortest time of the print cycle, wherein the processor executes:

a shortest time correction process of correcting the correction print cycle again by substituting the shortest time for the correction print cycle when the correction print cycle is less than the shortest time.

9. A tape creating method comprising:

a print starting step of starting printing dot-pattern data on a conveyed tape at an initial print cycle preliminarily stored;

a correction print cycle calculating step of repeatedly detecting a drive time in which a driving DC motor reaches a predetermined degree of rotation after start of printing on the tape, and repeatedly calculating a correction print cycle based on the detected drive time; and a print cycle correction step of correcting a print cycle in accordance with the correction print cycle calculated at the correction print cycle calculating step.

10. The tape creating method according to claim 9, comprising:

a first initial print cycle correction step of detecting a type of the tape, and correcting the print cycle based on a tape type correction value for correcting the initial print cycle preliminary stored corresponding to the type of the tape before start of driving of the DC motor.

11. The tape creating method according to claim 9, comprising:

a second initial print cycle correction step of correcting the initial print cycle based on one tape length correction value corresponding to one conveyance length correction value, after specifying the one of the plural kinds of conveyance length correction values preliminary stored for correcting a tape conveyance length before start of driving of the DC motor, wherein the print cycle correction step comprises a tape length correction step of correcting the correction print cycle based on the one tape length correction value corresponding to the specified conveyance length correction value.

12. The tape creating method according to claim 9, wherein the print cycle correction step comprises:

a shortest time correction step of correcting the correction print cycle again by substituting the shortest time for the correction print cycle when the correction print cycle is less than a preliminary-stored shortest time of the print cycle.

* * * * *